United States Patent [19]

Doyen et al.

[11] 4,312,281

[45] Jan. 26, 1982

[54] DEVICE FOR THE LINEAR TREATMENT OF A CURVED EDGE OF A SUPPLE PIECE OF FABRIC OR OTHER MATERIAL

[75] Inventors: Joël Doyen, Ste Savine; Jean-Pierre Raisin, Troyes, both of France

[73] Assignee: Agence Nationale de Valorisation de la Recherche, Neuilly, France

[21] Appl. No.: 151,821

[22] Filed: May 21, 1980

[30] Foreign Application Priority Data

May 29, 1979 [FR] France ..... 79 13659

[51] Int. Cl.[3] ..... D05B 19/00; D05B 27/00; D05B 35/10

[52] U.S. Cl. ..... 112/121.11; 112/309; 112/153

[58] Field of Search ..... 112/308, 309, 303, 121.11, 112/121.12, 121.15, 153

[56] References Cited

U.S. PATENT DOCUMENTS

| | | | |
|---|---|---|---|
| 3,650,229 | 3/1972 | Rouin | 112/308 X |
| 3,693,561 | 9/1972 | Hrinko, Jr. et al. | 112/308 X |
| 4,100,864 | 7/1978 | Babson et al. | 112/308 X |

FOREIGN PATENT DOCUMENTS

| | | | |
|---|---|---|---|
| 1302988 | 2/1971 | Fed. Rep. of Germany | 112/309 |
| 2252008 | 6/1975 | France | 112/308 |
| 2392909 | 12/1978 | France | 112/308 |

*Primary Examiner*—H. Hampton Hunter

*Attorney, Agent, or Firm*—Poms, Smith, Lande & Rose

[57] ABSTRACT

An installation for the linear treatment, such as sewing, along a curved edge, of a flexible piece of fabric or other material comprises: a sewing machine; a device for moving the piece along an axis; a work table for supporting the piece during its treatment; and a correcting device comprising: detection means for detecting the presence of the piece 1 in a zone upstream of the point of treatment and situated on one side with respect to the axis of treatment, and re-centering means comprising one part of the work table which is movable in rotation about an axis which is offset with respect to the axis of treatment and a motor controlled by the said detection means for driving the said part in rotation. The invention finds an application with cording machines in particular.

9 Claims, 12 Drawing Figures

Fig-6
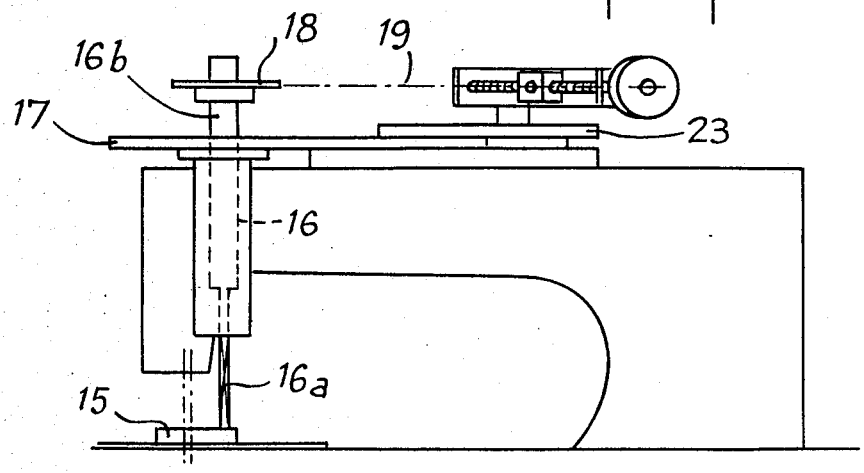
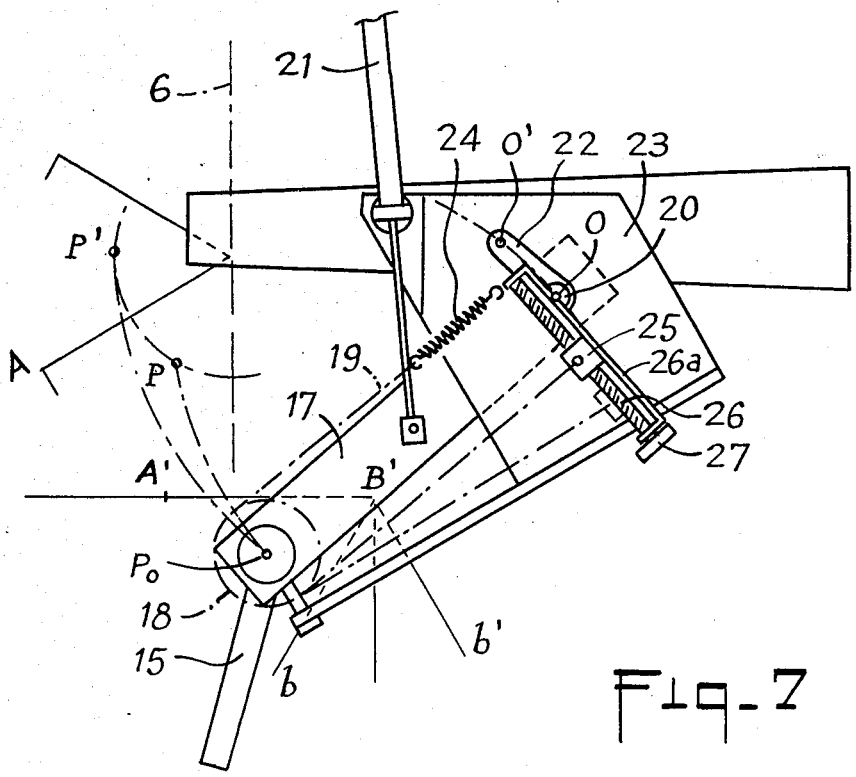
Fig-7

DEVICE FOR THE LINEAR TREATMENT OF A CURVED EDGE OF A SUPPLE PIECE OF FABRIC OR OTHER MATERIAL

BACKGROUND OF THE INVENTION

The present invention relates to a device for the linear treatment, such as sewing, along a line whose direction remains substantially tangent to a curved edge of fabric or other supple piece in sheet form. The device comprises a linear treatment machine with a fixed station having a fixed point of treatment; a guiding and driving device to make the fabric pass through the point of treatment and to move the zone of the piece which is being treated with respect to the treatment machine along a predetermined treatment axis; a work table extending around the driving device and situated substantially above the point of treatment for supporting the piece during the treatment; and a correcting device comprising means for detecting the presence of the piece in a detection zone of the work table situated upstream of the point of treatment and at least on one side of the axis of treatment, and a re-centering means controlled by the detection means for displacing the fabric substantially transversely with respect to the axis of treatment and in the appropriate direction as a function of the presence of the fabric on at least one point of the detection zone, in order that the fabric be treated by the treatment machine along a line which extends substantially in parallel to the curved edge of the fabric.

In an installation of this type described in French Pat. No. 2,252,008, the re-centering means comprise a roundabout, rotatable above the work table and the frame of the treatment machine, the roundabout comprising a plurality of shoes adapted to come in resting contact on the fabric being treated.

Such a device is complicated and requires the piece of fabric or other material to be kept flat and without folds on the work table during the treatment.

SUMMARY OF THE INVENTION

It is an object of the invention to remedy these disadvantages and to propose an installation smaller and simple in design.

This object is reached according to the invention due to the fact that the re-centering means comprises one part of a work table moving in rotation about an axis perpendicular thereto, and driving means controlled by the detector for driving the movable part in rotation in a suitable direction, depending on the presence of the piece at the point of the detection zone thereby causing the work table to ensure two functions: (1) supporting the piece to be treated and (2) re-centering it during its linear treatment.

Advantageously, the axis of rotation of the movable part of the work table is offset with respect to the axis of treatment.

Advantageously, the movable part of the work table is annular shaped and surrounds the point of treatment.

Advantageously, the movable part of the work table is a marginal peripheral zone of the work table.

Advantageously, the movable part of the work table is circular shaped and centered on its axis of rotation.

Advantageously, the detection device comprises two detection means, each one detecting the presence of the piece in at least one respective point of detection placed upstream of the point of treatment and offset with respect to the axis of treatment on either side of the axis and the driving means are controlled by the detection means for driving the movable part of the work table in rotation in a respective direction.

Advantageously, the detection device is an analog detector, extending transversely, with respect to the displacement of the piece, on at least one side of the axis of treatment, and the driving means are controlled by the detector for driving in rotation the movable part of the work table at a speed which is a decreasing function of the proportion of surface of this detector which is covered by the piece during treatment.

Advantageously, the detection device comprises at least two detectors each one being offset with respect to the sewing axis by a different distance, and the driving means are controlled by each of these detectors to drive the movable part of the work table at different speeds, the highest speed corresponding to the detector most remote from the axis of treatment, as soon as the corresponding detector detects the presence of the piece.

Advantageously, the installation further comprises means for bringing the front point of the curved edge to be treated, at the point of treatment, so that the axis of treatment is tangent to the edge at the point of treatment. The means comprises a shoe adapted to be applied on the piece part adjacent the front point of the edge to be treated which part lays flat on the work table. Driving means displaces the shoe sliding over the work table between two positions between which the shoe has pivoted through an appropriate angle about an axis perpendicular to the work table.

BRIEF DESCRIPTION OF THE DRAWINGS

The invention will be more readily understood on reading the following description with reference to the accompanying drawings, in which:

FIG. 6 is a schematic elevation of the sewing post of the installation shown in FIG. 3;

FIG. 7 is a schematic view of FIG. 6;

DETAILED DESCRIPTION OF THE PREFERRED EMBODIMENT

Figure 1:
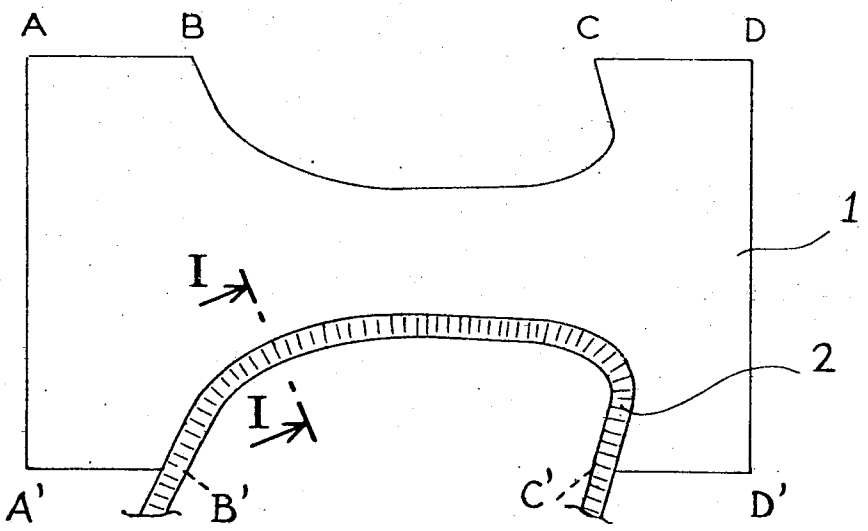
FIG. 1 is a plan view of a piece to be corded in a cording installation according to an embodiment of the invention.
Figure 1A:
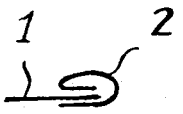
FIG. 1*a* is a cross section along I—I of FIG. 1.

The purpose of the illustrated installation is to ensure the automatic cording of a concave edge B'C' of a piece of fabric such as a piece 1 for men's underpants. The cording operation consists in depositing a band 2 astride edge BC, B'C' and along thereof (FIGS. 1 and 1*a*). The curved edge of the piece 1, of which the center or centers of curvature is or are situated outside the piece is considered the concave edge. The cording of the edge B'C' of the piece 1 will be described hereinafter. Obviously, the cording of the other edge BC of the piece 1 is effected in the same way.

This installation comprises a sewing machine 3 (FIG. 2), for example of the type with two needles and shuttles. The machine includes in known manner a guide 4 ensuring the folding ahd accurate presentation of the band 2, which is brought automatically by members (not shown), controlled in synchronism with the movement of the sewing machine 3.

Figure 2:
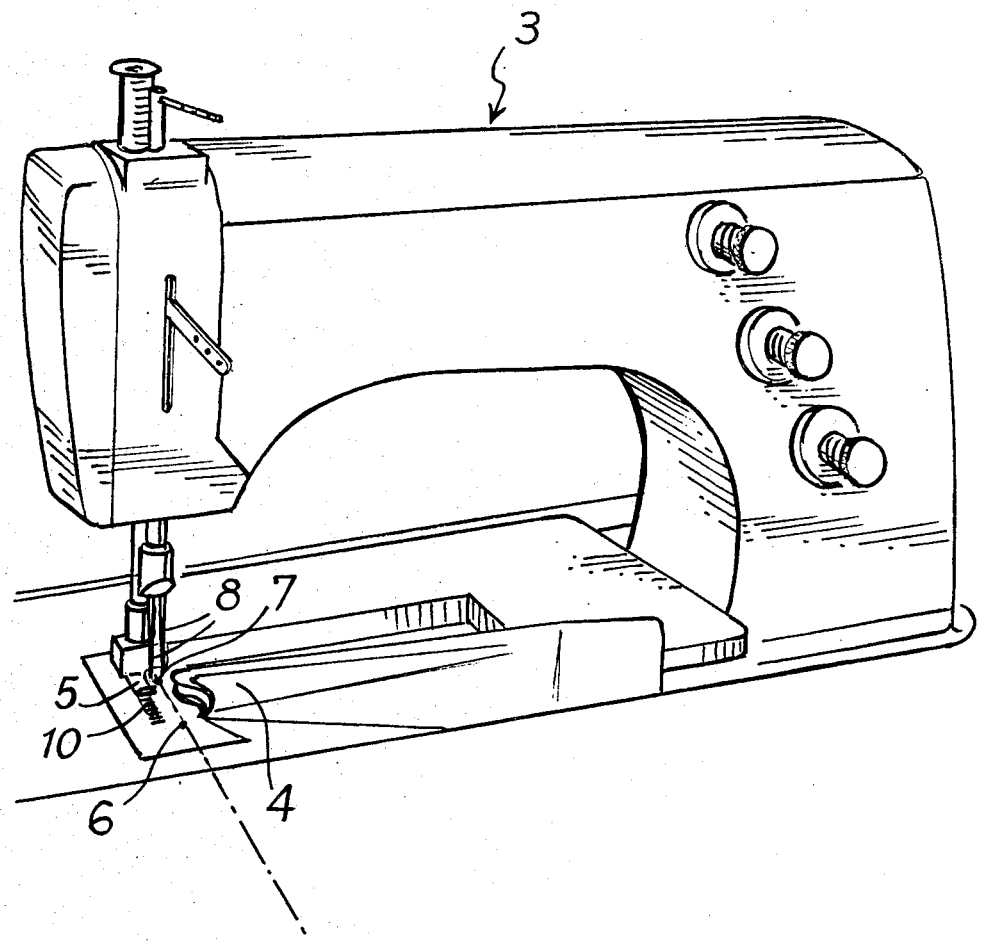
FIG. 2 is a perspective view of a cording machine according to an embodiment of the invention.

The problems to be solved in order to ensure the automatic cording of a concave edge such as B'C' are:

(1) to present the fore point B' of the edge B'C' under the presser foot 5 of the machine 3 in such a way that the sewing axis 6 of the machine 3 is tangent to edge B'C' at point B'; and (2) to guide the piece 1 all through the cording operation, so that the sewing axis 6 remains tangent to the edge B'C' at the point known as sewing point 7 where the needles 8 go through the piece 1 (FIG. 2).

Figure 3:
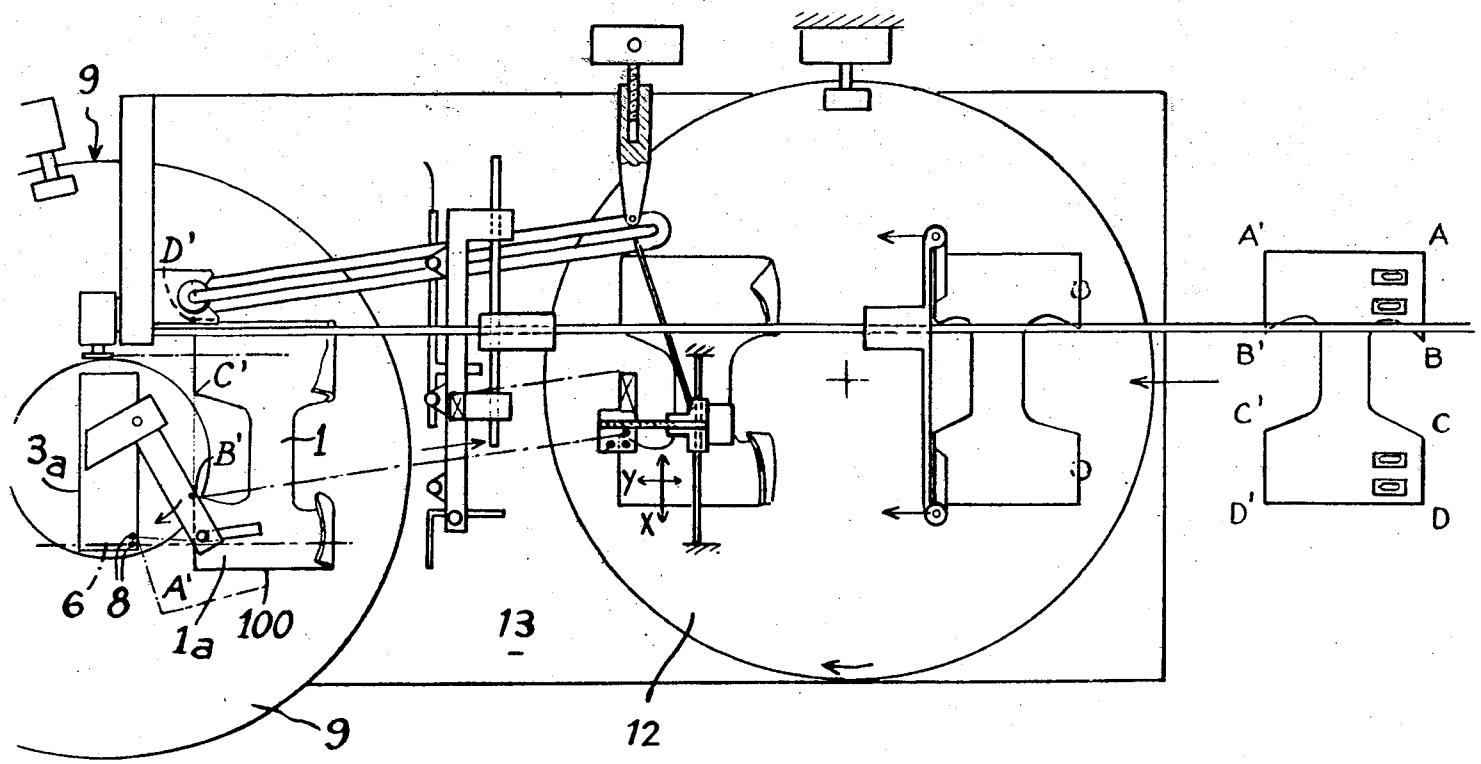
FIG. 3 is a schematic plan view of a whole cording installation according to the invention.

In the illustrated example, problem 1) is solved in two operations. In a first operation, the piece 1 is placed on the work table 9 (FIG. 3) of the machine 3 in a predetermined position and orientation 100 relative to the frame 3*a* of the machine 3, the edge A'B'C'D' being turned to face the frame 3*a* and being perpendicular to the axis 6, the edge A'B' being adjacent to the needles 8 (FIG. 3). In a second operation, the part 1*a* of the piece 1 adjacent the front end (point B') of the edge B'C' is gripped and is displaced flat by pivoting it on the work table 9, until part 1*a* covers a zone provided with driving teeth 10 situated under the presser foot 5 (FIG. 2), the point B' being substantially situated on the sewing axis 6 which is tangent to the edge B'C'.

Figure 4:
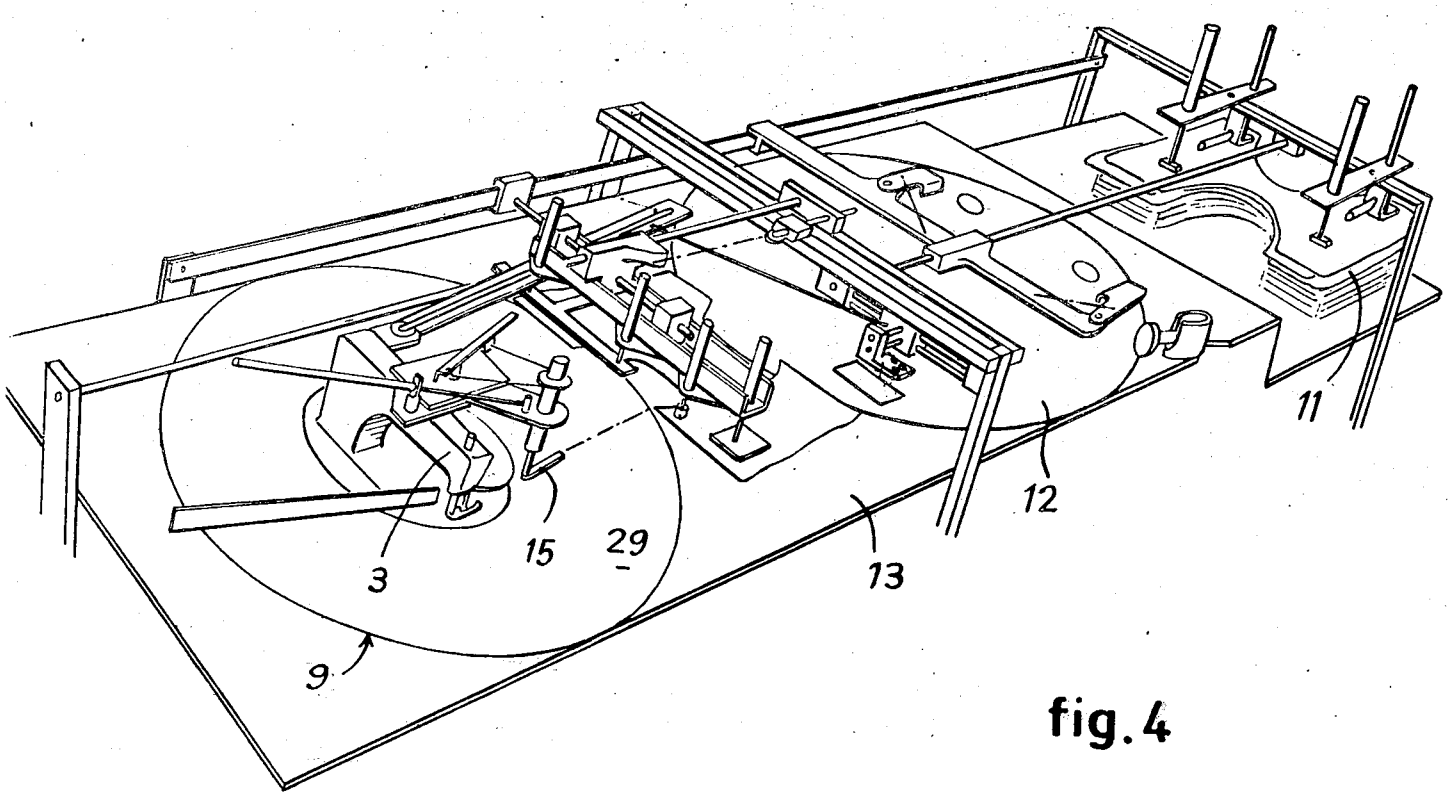
FIG. 4 is a schematic perspective of the installation shown in FIG. 3.

In the illustrated example, the first operation is carried out with the special handling and positioning means described in patent application Ser. No. 151,822. The handling means take up one by one the pieces 1 stacked in approximative manner in a pile 11 (FIG. 4) and deposit the pieces flat on a pivoting and horizontal transfer table 12, in a predetermined orientation relatively to the sewing axis 6. The table 12 is coplanar to the table 9. Then the handling means pick up each piece 1 again after table 12 rotates through 180° and carry it away flat by sliding over the table 12, over a fixed and horizontal connecting table 13 and over the work table 9 of the sewing machine 3 until piece 1 reaches its predetermined position 100.

It is obvious that the sewing axis 6 is the direction along which the driving device 10, 5 moves the zone adjacent to point 7 of the piece being sewn. The work table 9 is coplanar to tables 12 and 13 and is situated level with point 7, the tables 12, 13 and 9 joining up together to make up one horizontal sliding plane on which move the pieces 1.

The two successive operations for presenting the point B' to the (fixed) sewing point 7 of the machine 3 are necessary in the special case of the example described because of the special shape and dimensions of the pieces 1, which are such that at the position corresponding to the start of the sewing of the piece 1 (the point B' being at point 7 and the axis 6 being tangent at B' to the edge B'C'), one part 1*b* of the piece 1 (FIG. 5) encroaches the frame 3*a* of the machine 3, so that the piece 1 can no longer be kept flat on the work table 9. The part 1*b* necessarily becomes creased and bent in 14.

The handling and positioning means which ensure the positioning at 100 on the work table 9 of each piece 1 taken from the approximative pile 11, will not be further described hereinafter, as the reader can refer to the description of the aforesaid application Ser. No. 151,822.

Figure 5:
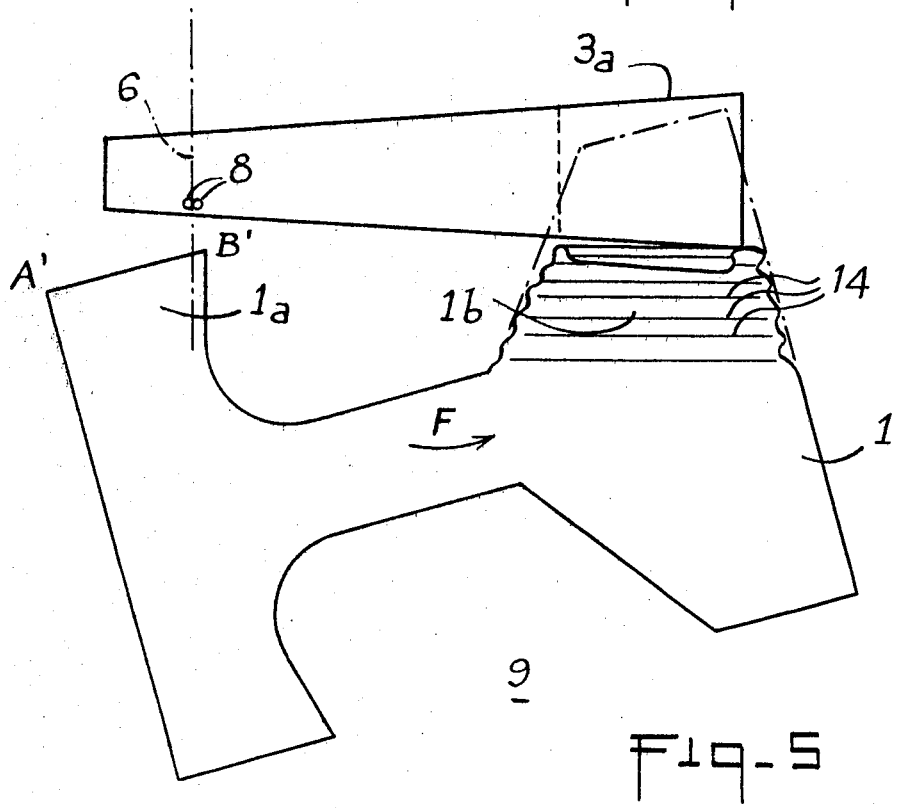
FIG. 5 is part of a plan view of the sewing post of the installation shown in FIG. 3, showing the impossibility to present the piece 1 under the needles 8 of the machine 3, by simple flat displacement of the piece 1 on the work table 9.

Thus, with certain designs of underpants and with certain shapes of edge B'C', the piece 1 cannot always be introduced under the presser foot 5 with a simple movement of translation. Due to the shape of the frame 3*a* of the sewing machine, the piece 1 is then forced back by the frame 3*a* at the level of the edge C'D' so that creases 14 form which impair the good progress of the sewing (FIG. 5).

FIGS. 6 and 7 show respectively, seen from the front and from above, an introduction device which ensures the presentation of point B' of the piece 1 under the presser foot 5. The device comprises a shoe 15 mounted at the lower end of a rod 16*a* of a jack 16, whose casing 16*b* is fitted on a support 17. Jack 16 can pivot about its axis with respect to the support 17 due to a toothed wheel 18 fixed on the rod 16*a* which is driven by a chain 19 meshing with the wheel 18. The support 17 pivots about an axis 20 by way of a second jack 21. Axis 20 consists of a vertical pin which can be moved along a slide 22 provided in a support plate 23 secured on the frame 3*a* of the sewing machine 3.

The piece 1 is presented under the presser foot 5 of the sewing machine 3 as follows. Starting with the shoe 15 in its stop position such as shown in FIG. 7, shoe 15 is urged against the piece 1 in its position 100 under the action of the jack 16. Then shoe 15 is slidably moved over the table 9 by the pivoting movement of the support 17 about its axis 20 under the action of the jack 21. During this presentation movement, the shoe 15 can pivot about its axis under the action of the toothed wheel 18 and of the chain 19, the two ends of which are respectively joined to a fixed spring 24 fitted by its other end to the support 23, and to a screw 26 by means of a milled knob 27 controlling the rotation of the screw 26. Screw 26 is mounted for rotation about its longitudinal axis on a support 26*a* itself fitted on the support 23.

Figure 8:
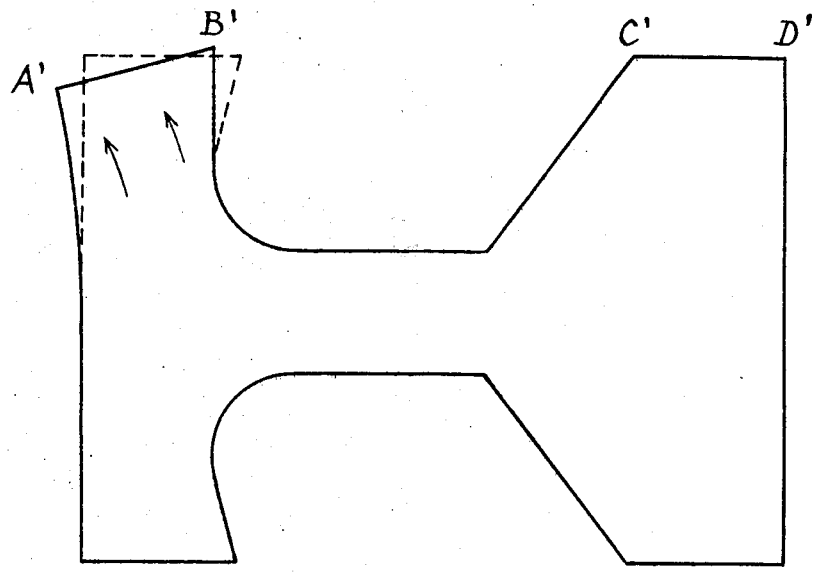
FIG. 8 is a plan view of a piece undergoing a deformation to be presented under the needles of the cording machine of the installation of FIG. 3.

This presentation movement of the shoe 15 is thus the result of the superimposition of two rotations; the top angle B' of the piece (FIG. 8) needs to be introduced in such a way that the first short distance bB' of the edge B'C' are aligned with the sewing axis 6 (FIG. 7). Depending on the inclination of the part of edge bB' with respect to the sewing line 6, the rotations will be adjusted in order to deform more or less the part A'B'C' of the piece 1 (FIG. 8).

FIG. 7 shows two piece profiles A'B'b and A'B'b', the angles of which in B, being very different, require a different movement of introduction. Whatever the angle, the starting position and the application point $P_o$ of the shoe 15 on the piece 1 are identical.

In order to accurately introduce the angle B' under the presser foot 5 and to align the segment B'b on the sewing axis 6, two adjustments are advantageously effected. A first adjustment controlling the amplitude of rotation of the shoe 15 with a view to placing the edge B'b in line with the sewing axis 6 is obtained by displacing the nut 25 on the threaded rod 26. Depending on the position of nut 25, the shoe 15 pivots more or less about its axis during the rotation of the support 17 about the axis 20; A second adjustment displaces the pivoting axis 20 of the support 17 along the slide 22. This adjustment must take into account the preceding adjustment and the rotation of the shoe 15 about its own axis. The adjustment affords the possibility of compensating the change of co-ordinate of the angle B' caused by the rotation of the shoe 15 about its own axis.

Each type of piece 1 requires a special presentation and movement of introduction which is dependent on the shape of the edge A'B'C'.

Both these adjustments are advantageously defined from the determination of the point P (FIG. 7) which corresponds to the arrival position of the shoe 15, which position makes it possible to present the angle B' under the needles 8 at the point 7, and to align the edge B'b or B'b' with the sewing axis 6.

It is then possible with point P to determine the pivoting point O of the support 17 whose position is situated at the intersection of the circles C1 (center P, radius OP) and C2 (center Po, radius OP).

Depending on the position of the pivoting point O, the rotation of the shoe 15 resulting from the pivoting movement of the support 17 under the action of the jack 21, can be adjusted by way of the milled knob 27. The amplitude of the rotation is dependent on the position of the nut 25. If considering the angle A'B'b, the nut has to be positioned so as to cause the axial direction of the shoe 15 to pivot through a value equal to $(\pi/2)-\alpha$, $\alpha$ being the value of the angle A'B'b.

In FIG. 7, the positions P' and O' relate to the case where the pieces 1 have an angle A'B'b greater than $\pi/2$, whereas the positions P and O relate to the case where the pieces 1 have an angle A'B'b less than $\pi/2$.

To sum up, the introduction shoe affords the possibility of presenting all the different pieces of standard type under the presser foot by two relatively simple adjustments.

The sewing machine 3 is also associated with means ensuring the automatic guiding of the piece 1 during the cording operation, the effect of which guiding being to keep the sewing axis 6 tangent to the edge B'C' at the sewing point 7.

Figure 9:
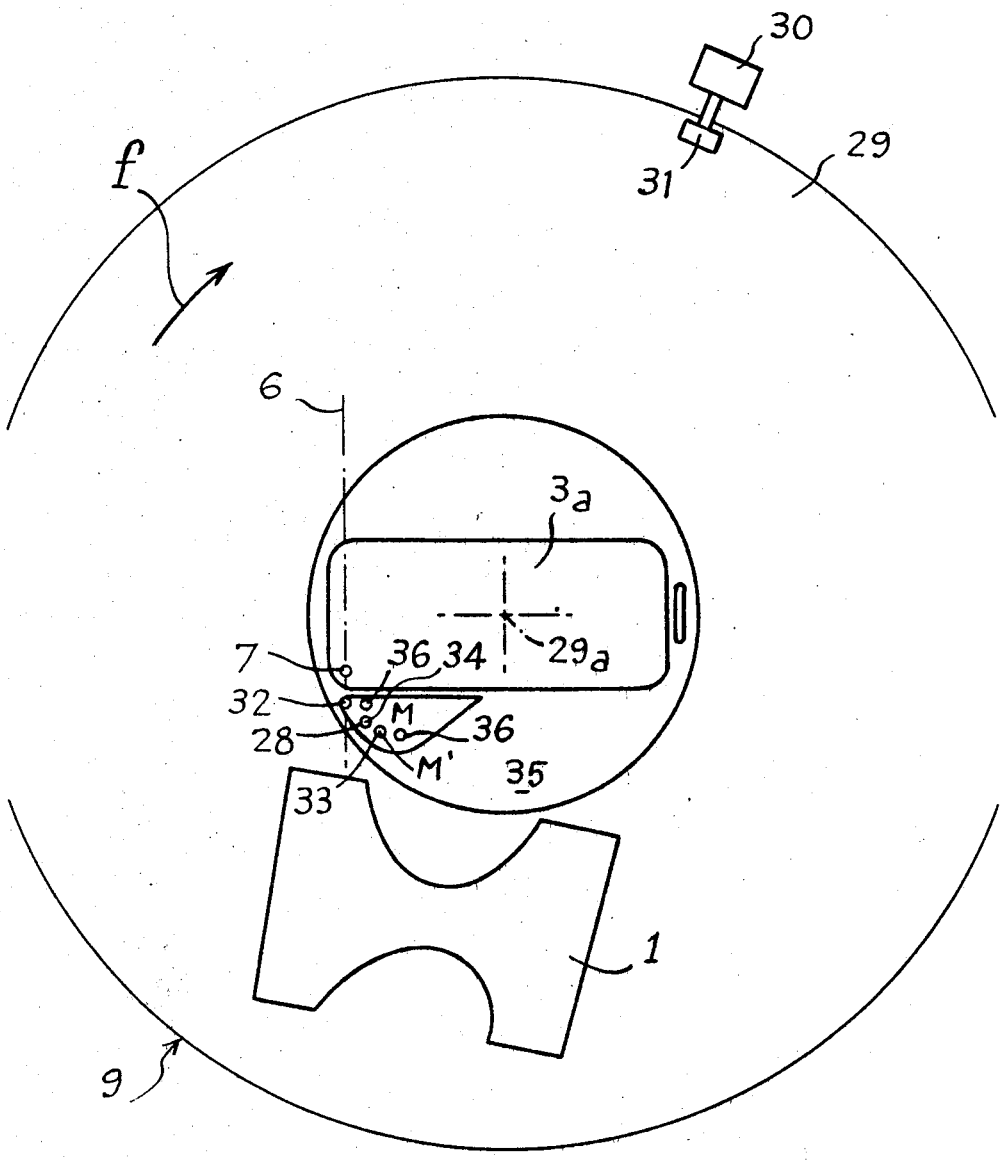
FIG. 9 is a schematic plan view of the sewing post of the installation shown in FIG. 3, which does not show the introduction device illustrated in FIGS. 6 and 7.

Self-guiding means, shown in the embodiment of FIG. 9, comprises:

a detector 28 for detecting the presence of the piece 1 in a point M of the table 9, which point is offset towards the right in FIG. 9, with respect to the sewing axis 6, and is situated upstream of the point 7 relatively to the advanced movement of the piece 1 being sewn; and a circular ring-shaped part 29 of the work table 9, which part 29 is pivotally movable in its own plane about its axis 29*a*, perpendicular thereto, and can be driven in rotation about the axis by a motor 30, via a runner 31 running with friction on the periphery of the movable part 29.

The correcting detector 28 comprises, for example, a photo-electric cell which detects the presence (or the absence) of the piece 1 at point M and which, as will be explained hereinafter, controls during sewing the position of the edge B'C' of the piece 1 with respect to the sewing axis 6.

The movable part of table—or circular self-guiding table—29 pivots about its axis 29*a*, which axis is advantageously situated in the center of the frame 3*a*, in plan view, of the sewing machine 3. Another detector 32 is placed on the axis 6 immediately upstream of the point 7. Detector 32 sets the sewing machine 3 into operation as soon as it detects the presence of the piece 1 above it and stops the machine when the piece 1 is no longer above it, such stopping control being however effected within a time interval which takes into account the distance between the point 7 and the detector 32.

The self-guiding means operate as follows:

The introduction of the edge B'C' under the presser foot 5 causes, through the action of the detector 32, the starting of the sewing machine 3 which machine ensures the forward drive of the piece 1 by its teeth 10 and its presser foot 5. Because of its curved shape, the edge B'C' of the piece 1 is moved diagonally towards the right in FIG. 9 and therefore off the sewing axis 6. It then interrupts the light beam from the photo-electric cell 28 which then starts the motor 30 to rotate the self-guiding table 29 to bring back the segment of edge B'C' in the sewing axis 6. As soon as the light beam of the cell 28 is restored, the motor 30 stops.

In the present embodiment, the self-guiding plate 29 can pivot at two predetermined speeds in order to take into account the very pronounced curvatures corresponding to small size articles: a second correction detector 33 is used and placed at point M' of the table 9, point M' being situated at a greater distance from the axis 6 than the point M and upstream of point M, relative to the advance direction of the piece 1 during cording.

When the photo-electric cell 28 detects the presence of the piece 1 to rotate the self-guiding plate 29 through the action of the motor 30, the motor has a rotation speed $V_1$. In the case of a very pronounced curvature, the edge to be sewn interrupts the light beams of the cells 28 and 33 of which the positions on the work table 1 have been predetermined in relation to the pronounced curves. The changes of condition of the two detectors 28 and 33 control the rotation of the self-guiding plate 29 to a speed $V_2$ greater than $V_1$. The faster predetermined speed of correction determined at the position of the detector 33 thus permits a better correction.

In order to hold the piece 1 in position on the table 9 where the detectors 28, 32 and 33 are situated, a guiding wall 34 is used which is fitted on the fixed circular middle part 35 of the table 9 at a distance thereof slightly greater than the thickness of the pieces 1 to be corded. The wall 34 can carry one of the elements (light source or light pick up) of the detection devices 28, 32 and 33. Between the wall 34 and the table part 35, mechanical stop means such as runners 36 can be fitted in order to limit the shifting towards the right of the edge B'C' during the sewing operation before the automatic guide means 28 to 31 and 33 have been able to act.

The self-guiding table 29 constitutes a peripheral marginal zone of the table 9.

It is also to be noted that the detectors 28, 32, 33 are mounted on the middle fixed portion 25 of the table 9, which joins up with substantially no play—or interstices—with the movable part 29.

Thus the presentation of the edge in line with the sewing axis is automatic all through the sewing due to the self-guiding table 29 of which the small consecutive rotations permit to bring back the edge B'C' in line with the sewing axis 6.

The rotations of the self-guiding table 29, at speeds $V_1$ or $V_2$, are clockwise in FIG. 9 (arrow f).

The invention of course is not limited to the embodiment described hereinabove which is adapted to the case where the edge to be treated is concave.

In the case where the edge is of any curved shape, for example, successively concave and convex, it is possible to use another type of embodiment of the installation according to the invention, to ensure the guiding of the said edge throughout the sewing operation.

Figure 10:
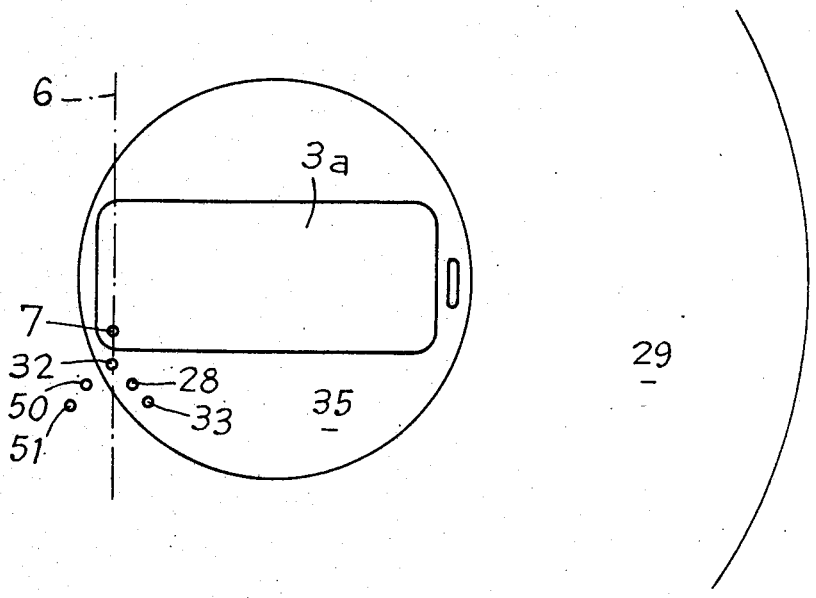
FIG. 10 is a similar view to FIG. 9 showing a second embodiment of the correcting device.

The embodiment, which is illustrated in FIG. 10, consists in adding to the photo-electrical detector 28 a second pick up 50.

Both pick ups are situated upstream of the point 7 and on either side of the axis 6 respectively; said pick ups then define a more or less large detection zone. The edge of the piece 1 will have to be kept inside the zone by rotations in one direction or the other of the guiding plate 29.

Depending on the conditions of the detection pick ups 28, 50, the rotation of the motor 30 will be controlled in one direction or the other if the pick ups are both uncovered or both covered, or the motor will be stopped if one of the pick ups is uncovered and the other covered.

The rotation at different speeds in the two directions can also be controlled by associating to the second pick up 50, an intermediate pick up 51 playing the part of the auxiliary pick up 33 and by placing both auxiliary pick ups 51, 33 symmetrically on either side of the axis 6 and of the detection zone defined this way.

Figure 11:
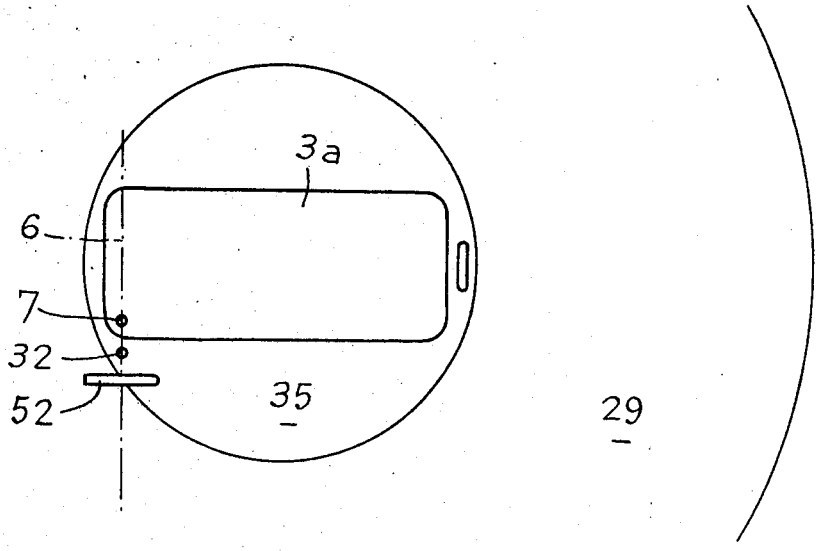
FIG. 11 is a similar view to FIG. 9, but showing a third embodiment of the correcting device.

According to another embodiment shown in FIG. 11, an elongated analog pick up 52 is used instead of the pick ups 28, 33, 50, 51, which analog pick up permits controlling the position of the edge with respect to the median axis of a detection zone and simultaneously controlling the return speed of the edge to its correct position with respect to the distance separating it from the median axis of the detection zone (the axis representing the ideal position of the edge).

Pick up 52 extends substantially transversely to the moving direction of the piece 1 and over the whole detection zone, so as to deliver a signal of which the sign defines the direction of rotation of the motor 30 and of which the amplitude proportional to the distance between the edge and the median axis of the detection zone defines the speed of rotation.

A nil signal corresponds therefore to the piece covering half the surface of the pick up 52 and a positive or negative signal corresponds to the piece covering a surface respectively smaller or greater than the half of the surface.

This means affords the possibility of guiding the edge of an article presenting any type of curvature and of acting simultaneously on the speed of rotation of the motor. Of course the movable part 29 of the table 9 must be transported in the case of embodimehts of FIGS. 10 and 11 so as to permit the operation of detectors 50, 51, 52.

What is claimed is:

1. An installation for the linear treatment, such as sewing, along a line whose direction remains substantially tangent to a curved edge of a supple piece such as a piece of fabric comprising: a linear treatment machine with a fixed station having a fixed point of treatment; a guiding and driving device to make the piece pass through the point of treatment and to move, with respect to the treatment machine, the zone of the piece which is being treated, along a predetermined treatment axis, a work table extending around the driving device, the work table having a detection zone and being situated substantially above the point of treatment for supporting the piece during the treatment; and a correcting device comprising:

detecting means for detecting the presence of the piece at the detection zone of the work table situated upstream of the said point of treatment and on at least one side with respect to the axis of treatment, and re-centering means on the work table, controlled by the detection means for displacing the piece substantially transversely with respect to the axis of treatment and in the appropriate direction, as a function of the presence of the piece on at least one point of the detection zone, in order that the piece be treated by the treatment machine along a line which extends substantially in parallel to the curved edge of the piece, wherein the re-centering means comprise a movable part of a work table offset with respect to the axis of treatment, moving in rotation about an axis perpendicular to the work table, and driving means controlled by the detector for driving the movable part in rotation in a suitable direction depending on the presence of the piece at the point of the detection zone, thereby causing the work table to support the piece to be treated and to re-center the piece during its linear treatment.

2. The installation of claim 1, wherein the movable part of the work-table is annular shaped and surrounds the point of treatment.

3. The installation of claim 1, wherein the movable part of the work table is a marginal peripheral zone of the work-table.

4. The installation of claim 1, wherein the movable part of the work-table is circular shaped and centered on its axis of rotation.

5. The installation of claim 1, wherein the detecting means comprises two detection members each one detecting the presence of the piece in at least one respective point of detection placed upstream of the point of treatment and offset with respect to the axis of treatment on either side of the axis, respectively, and the driving means are controlled by the detecting means for driving the movable part of the work table in rotation in a respective direction.

6. The installation of claim 1, wherein the detecting means is an analog detector extending transversely with respect to the displacement of the piece, on at least one side with respect to the axis of treatment, and the driving means are controlled by the detector for driving in rotation the movable part of the work table at a speed which is a decreasing function of the proportion of surface of this detector which is covered by the piece during treatment.

7. The installation of claim 1, wherein the detecting means comprises at least two detectors each one being offset with respect to the sewing axis by a different distance, and the driving means are controlled by each of these detectors to drive the movable part of the work table at different speeds, the highest speed corresponding to the detector most remote from the axis of treatment, as soon as the corresponding detector detects the presence of the piece.

8. The installation of claim 1, further comprising means for bringing the front point of the curved edge to be treated, at the point of treatment, so that the axis of treatment is tangent to said edge at said point of treatment, said means comprising a shoe adapted to be applied on the piece part adjacent the front point of the edge to be treated, said part laying flat on the work table, and driving means for displacing the shoe sliding over the work table between two positions between which the shoe pivots through an appropriate angle about an axis perpendicular to the work table.

9. The installation of claim 1, wherein the axis of rotation of the movable part of the work table is situated in the center of the frame of the treatment machine.

* * * * *